US006217465B1

(12) United States Patent
Kenia, Jr.

(10) Patent No.: US 6,217,465 B1
(45) **Date of Patent: *Apr. 17, 2001**

(54) IMPACT RELIEF TOOL

(76) Inventor: Gerald Kenia, Jr., 1854 Windwood Ave., Rochester Hills, MI (US) 48307

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/076,640

(22) Filed: May 12, 1998

(51) Int. Cl.[7] ..... A63B 57/00
(52) U.S. Cl. ..... 473/408
(58) Field of Search ..... 473/408, 406, 473/286; D21/793; 30/155–161

(56) References Cited

U.S. PATENT DOCUMENTS

| | | | | |
|---|---|---|---|---|
| 2,647,311 | | 8/1953 | Arden . | |
| 2,914,850 | | 12/1959 | Kuhnl . | |
| 3,049,182 | | 8/1962 | Pelow | 473/408 |
| 3,618,673 | * | 11/1971 | Gossett | 473/408 |
| 3,620,426 | * | 11/1971 | Hatch | 473/408 |
| 4,007,928 | * | 2/1977 | Doubt | 473/408 |
| 4,386,774 | * | 6/1983 | Buckman | 473/408 |
| 5,143,371 | * | 9/1992 | Stahan | 473/408 |
| 5,405,133 | | 4/1995 | Upton | 473/408 |
| 5,419,551 | * | 5/1995 | Hoyt et al. | 473/408 |
| 5,449,169 | | 9/1995 | Hardin et al. . | |
| 5,562,553 | | 10/1996 | Digerness et al. . | |
| 5,685,079 | * | 11/1997 | Brothers et al. | 30/155 |
| 5,689,890 | * | 11/1997 | Glesser | 30/155 |

* cited by examiner

*Primary Examiner*—Steven Wong
(74) *Attorney, Agent, or Firm*—Michael I Kroll

(57) ABSTRACT

An impact relief tool (14) comprising a handle (16) to be grasped by a hand of a person (18). A blade (20) extends from a front end (22) of the handle (16). The blade (20) has dull edges (24) formed thereon and a blunt point (26) on a forward end, so that it can be easily inserted by the person (18) below a concave ball mark (28) and compacted area (29) made by a golf ball (30) striking a golf green turf (32), to leverage the golf green turf (32) inwardly relieving the compacted area (29) and for repair and leveling thereof.

1 Claim, 7 Drawing Sheets

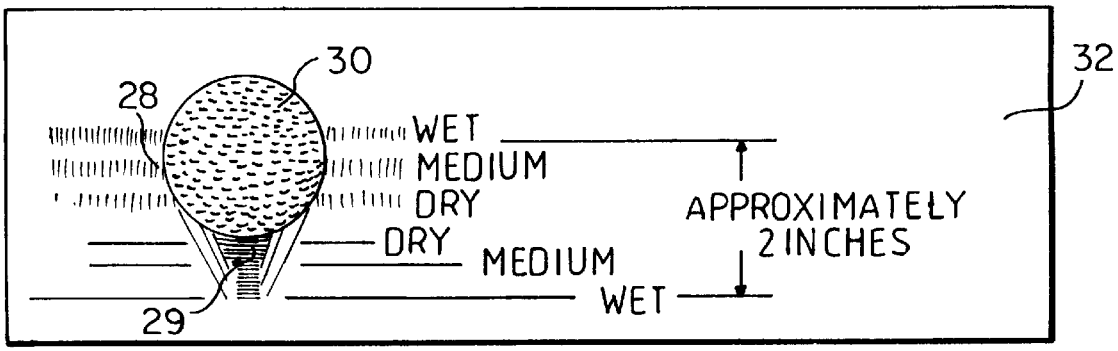
Fig. 1
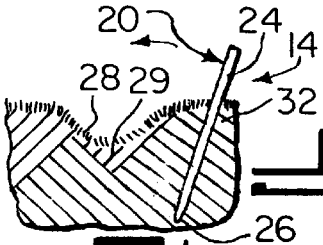
Fig. 2
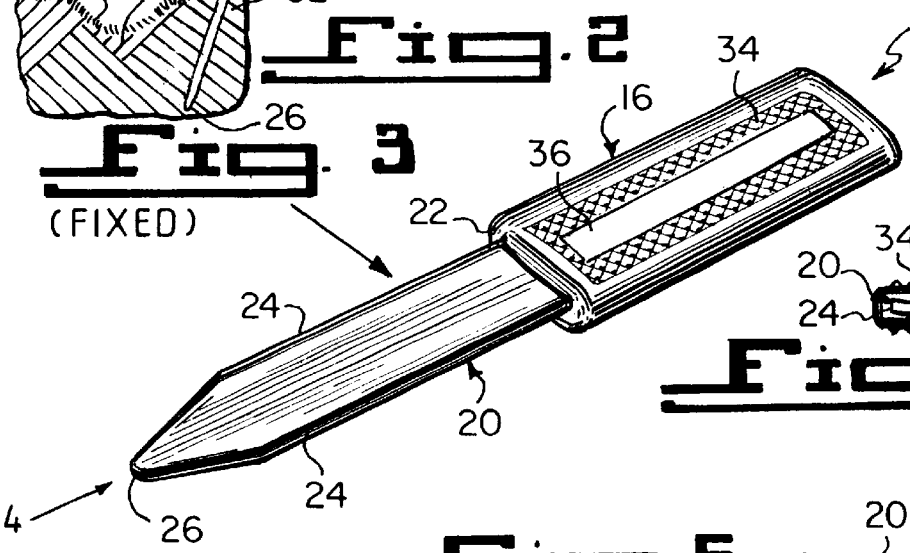
Fig. 3
(FIXED)
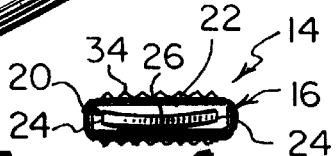
Fig. 4
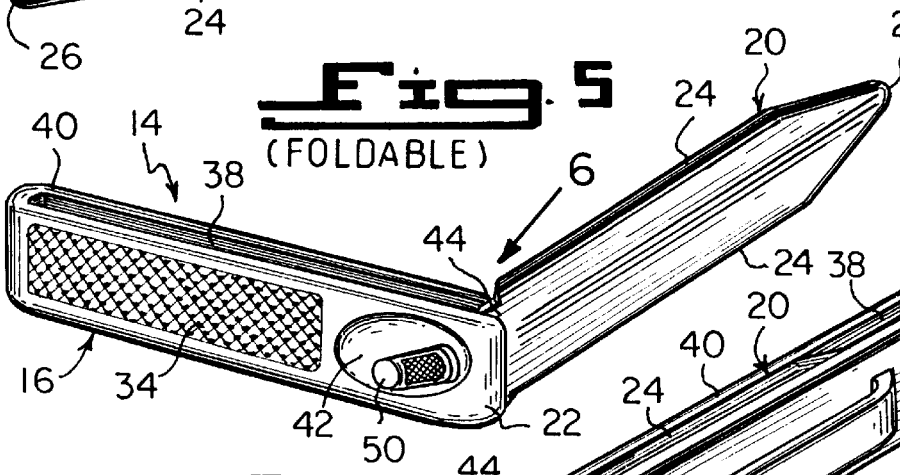
Fig. 5
(FOLDABLE)
Fig. 6
(BELT CLIP)

Fig. 9A
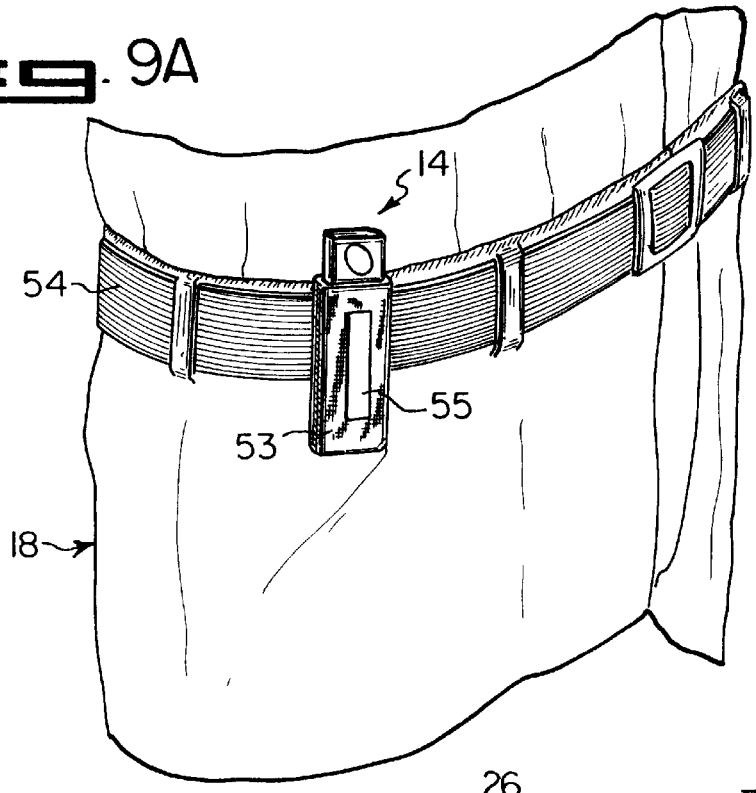
Fig. 14
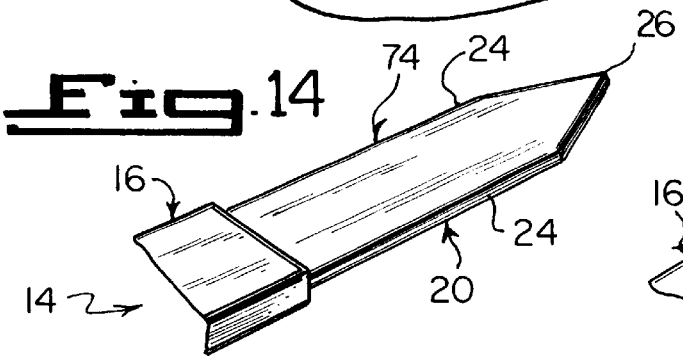
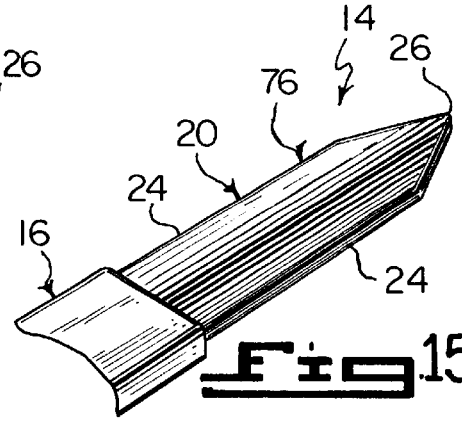
Fig. 15
Fig. 16
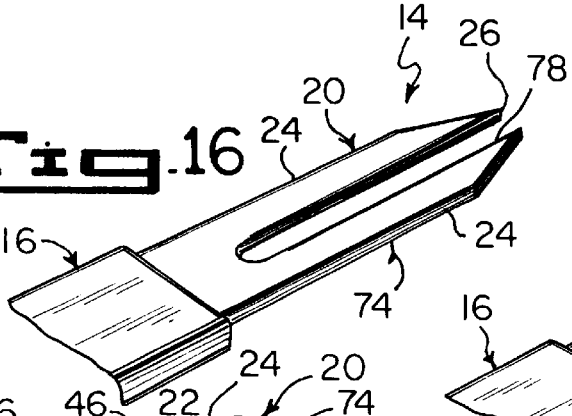
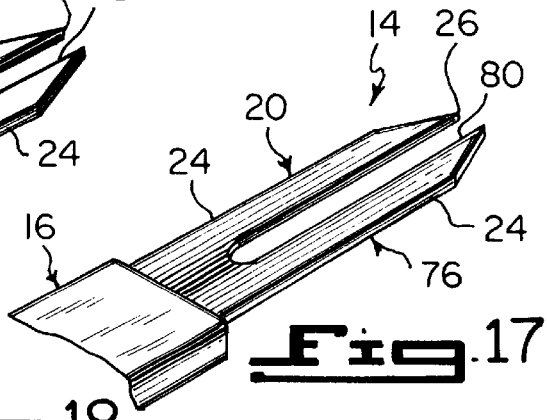
Fig. 17
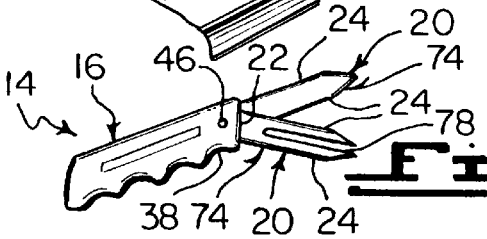
Fig. 18

IMPACT RELIEF TOOL

BACKGROUND OF THE INVENTION

1. Field of the Invention

The instant invention relates generally to pocket knives and repair tools and more specifically it relates to an impact relief tool. The impact relief tool is constructed for use by a greens keeper, to relieve an impact caused by a golf ball striking and indenting the surface of a golf green.

2. Description of the Prior Art

Numerous pocket knives and repair tools have been provided in prior art. For example, U.S. Pat. No. 2,647,311 to Arden; U.S. Pat. No. 2,914,850 to Kuhnl; U.S. Pat. No. 3,049,182 to Pelow; U.S. Pat. No. 5,405,133 to Upton; U.S. Pat. No. 5,449,169 to Hardin et al. and U.S. Pat. No. 5,562,553 to Digerness et al. all are illustrative of such prior art. While these units may be suitable for the particular purpose to which they address, they would not be as suitable for the purposes of the present invention as heretofore described.

ARDEN, THOMAS R.

DETACHABLE BLADE POCKET KNIFE

U.S. Pat. No. 2,647,311

A pocket knife comprising a handle, a shank pivoted at one end to the handle for swinging movements between open and closed positions relative thereto. The shank at one face thereof and near its pivoted end being recessed and thereby being provided with an inwardly facing shoulder at the outer end of the recess. The shank outwardly of the recess being of substantially uniform thickness from face to face and the upper and lower edges of the shank outwardly of the shoulder being substantially parallel. The edges having therein channels which extend longitudinally of the shank and which are aligned with the face of the recess. The channels open through the outer end of the shank and have their inner ends terminating outwardly of the shoulder. A thin, laterally flexible, normally flat blade has therein a longitudinally extending slot the outer end portion of which is of a width approximately equal to the distance between the bottoms of the channels in the shank. The blade-slot being otherwise of approximately the same size and shape as the shank outwardly of the shoulder. It is engageable and interlockable with the shank by sliding the same rearwardly relative to the shank under lateral flexure to engage portions thereof at both sides of the slot therein with the grooves of the shank and to engage the portion thereof at the rear end of the slot therein behind the shoulder.

KUHNL, LEOPOLD K.

RAZOR BLADE KNIFE

U.S. Pat. No. 2,914,850

A razor blade pocket knife comprising, a handle having a vertical slot formed therein. A blade holder is pivotably mounted at one end of the handle for movement between an open position and a closed position within the slot. The holder has a U-shaped cross section inverted when in the closed position. A blade carrier is pivotably mounted at the one end of the handle coaxial with the holder and pivotable relative to the holder and in the plane thereof to a position within the holder. Means on the carrier is adapted to support a razor blade whereupon the carrier and the blade are adapted to be pivoted into the holder with the cutting edge of the blade projecting therefrom. Means defining a notch formed in the handle extends transversely through the slot and extends in depth beyond the inverted edges of the U-shaped blade holder when in the closed position in the slot. The edges where the blade projects from the holder act as abutments engageable by a person's fingernails to facilitate opening of the knife.

PELOW, WILLIAM E.

TURF REPAIR TOOL

U.S. Pat. No. 3,049,182

A hand manipulated turf working tool comprising handle means including a substantially planar member. A blade abutment element is positioned at one end thereof. The blade abutment element has a first surface. A blade assembly includes a blade support portion pivotally connected to the end of the planar member, remote from the end accommodating the abutment element. A plurality of spaced turf-penetrating tines are connected at one end to and project longitudinally of the blade support portion. The turf-penetrating tines each having a curvilinear cross-section. The turf-penetrating tines are arranged coplanar and are arranged relative to one another, so that the spaced between adjacent tines exceeds the width of the tine. The first surface has a height above the planar member at least as great as that of the blade support portion. The blade assembly from the pivotal connection to the free ends of the tines are of such length that the blade assembly has a first operating position wherein the blade assembly forms an axial extension of the handle means and a second storage position wherein the blade assembly overlies the planar member with one of the turf-penetrating tines engaging the first surface and the ends of the tines disposed below the upper vertical limit of the first surface.

UPTON, LYLE

FOLDING BALL MARK REPAIR TOOL

U.S. Pat. No. 5,405,133

Disclosed is a folding ball mark repair tool for repairing a ball mark depression in a golf green resulting from impact of a golf ball landing on the green, thereby leaving the green free of a surface irregularity that may adversely effect putting conditions. The ball mark repair tool comprises an elongated flat blade for insertion under a concave ball mark in greens turf for prying the turf upwardly for smoothing thereof. The blade has two parallel pointed prongs extending from an end thereof. An elongated flattened handle has a longitudinally central slot formed therein, wherein the blade shank is pivotally disposed such that the blade may be pivoted to a storage position thereof, wherein the blade is disposed within the slot and a working position thereof, wherein the blade is approximately 180 degrees from the storage position extending out of the slot. A spring pivotally biases the blade to the working position. A latch is included whereby the blade may be releasably retained in the storage position. The latch is biased to a blade engageable latch position and also has a blade disengageable release position. The latch also has a finger engagement button formed on one end thereof which projects slightly above the surface of the handle when the rod is in the latch position, whereupon finger pressure by a user causes the blade to spring from the storage position to the working position.

HARDIN, CLAUDE R.

HARDIN, RANDY G.

RETRACTABLE DIVOT REPAIR TOOL

U.S. Pat. No. 5,449,169

A retractable divot repair tool assembly comprising a divot repair tool in a generally planar configuration. The tool has long parallel side edges, a short linear bottom edge coupling the side edges and an upper portion formed in a generally V-shaped configuration. The lower portion of the tool being in a generally rectangular configuration of a length slightly less than the length of the upper V-shaped portion with an aperture therethrough and a recess in the aperture. A housing in a generally box-like configuration has rectangular front and rear walls, a bottom wall at right angles with respect thereto and parallel side walls coupling the side edges of the front and rear walls and the side edges of the bottom wall, the container having an opened upper end. The container also having a longitudinal slot on the front wall along the majority of its length thereof parallel with the side walls and with short upper and lower transverse slots adjacent to the upper end and lower end of the longitudinal slot. Mechanisms are to move the divot repair tool between a stored orientation within the container and an operative orientation exterior of the container.

DIGERNESS, ROBERT L.

STALZER, CHRIS M.

SMITH, SCOTT C.

LORD, CHARLES S.

MULTI-PURPOSE GOLFER'S TOOL

U.S. Pat. No. 5,562,553

A multipurpose golfer's tool is disclosed comprising a body and a divot repair tool slideably received within the body. The divot repair tool comprises a fork-like end and a distal end opposite the fork-like end. A cover is hingedly attached to the distal end and is positioned on the exterior of the body. The cover is easily manipulable to slide the divot repair tool from a retracted position within the body to an operating position. The cover also has a generally planar surface for imprinting indicia thereon. The tool further comprises a pencil sharpener mounted in the body, a detachable ball marker mounted on the body, and a club head groove cleaner mounted on the body.

SUMMARY OF THE INVENTION

The impact relief tool is designed to be used by professional golf course superintendents and their golf course maintenance crews conveniently worn on the hip, attached to the belt, by a belt clip, or protective belt-attached sheath. Other models may be carried in the pocket, depending solely on personal preference. The tool was designed to become a vital part of the golf course maintenance persons daily attire; a major tool and asset of the trade.

The tool was designed to function equivalent or similar to the process known as golf course greens deep thining. A compact tool which will perform an equivalent function in a concentrated area as would be performed by a crew and large hydraulic driven machinery, which would be used to perform the same function across the entire green surface. Providing ongoing repair and maintenance during the interim periods between golf course greens resurfacing. By doing this the tool will become a vital asset to golf course maintenance staff for the purpose of relieving compaction, especially the concentrated compaction caused by the impact of a golf ball striking the surface of a green.

Deep thining is the process of mechanically driving steel rods measuring up to three quarters of an inch in width and twelve inches in length into the greens turf area, for the purpose of relieving compaction, and rejuvenating the surface of the putting green. Another method commonly used to achieve a near equivalent function is called aerating, which is achieved by driving equivalently sized hollow steel rods into the greens surface and actually pulling or removing a core of grass plants and root systems. Both processes are in the majority of cases finished off by a process called top dressing. Where sand or a sand mixture is spread across the surface of the entire green area and groomed "dragged" with net-broom-or mesh attachment, causing the sand mix particles to fall into and fill the voids caused by driving the steel rods into the surface of the green.

The relief of compaction on golf course greens is a vital ongoing process in the overall professional maintenance of a healthy manicured golf course green, extremely necessary. Compaction is caused by a number of reasons, amount of play, weather conditions, fertilizer and sprays used, type of seed, location of the green on each individual course, location of the golf course itself "region of the country", amount of sunlight each green receives, use of mowers traveling over the green, use of other equipment in the ongoing maintenance traveling over the green, impact of a golf ball striking a green, the total make up of the green itself "what type of mix does it consist of" (most greens are made of a sand mix, which may consist of permeable sand and many other additives, which may include humus or even processed human sludge, older greens may have been totally comprised of topsoil), is there and how well does a green drain, how does the under layment of the green perform, is there a drainage system under the green, most modern greens are constructed with extensive underlying drainage systems, covered by different sized gravel, before the green mix itself is applied to provide the most efficient perkulation possible, does the green perk, and have sufficient drainage.

As we can imagine, the relief of compaction is a major concern and an essential process performed on an ongoing basis by all golf course superintendents and their maintenance crews. On a large scale, compaction relief is accomplished with the use of large hydraulic driven machinery powered by a tractor, or self propelled equipment, accompanied by a crew of maintenance personal.

The impact relief tool was designed to provide immediate relief from compaction and trauma and repair to certain concentrated areas that need immediate attention without the use of powerful, and cumbersome machinery, large hand tools, and crews. The tool is targeted for use on small scale blemishes, spike marks, damage caused by player ignorance, damage caused intentionally by disgruntled golfers, small scale animal damage (squirrels, chipmunks, moles, etc.), deer walking across, and ball marks caused by the golf ball striking the surface of the green.

Small scale puddling (standing pools of water, grease and oil droppings) from use of machinery (mowers and etc.), which kill spotted areas, small scale scalpings and dig marks caused by failing mowers and inattentive operators. All of which can be immediately repaired with the convenient impact relief tool, which is always on hand to provide relief for the meticulously manicured putting surface, keeping the surface continuously free of defects.

A first object of the present invention is to provide an impact relief tool that will overcome the shortcomings of the prior art devices.

A second object is to provide an impact relief tool that is constructed to be used by a greens keeper, to relieve the underlying impaction and trauma to the grass plant caused by a golf ball striking and indenting the turf on a golf green.

A third object is to provide an impact relief tool that will allow the greens keeper to lean over and properly repair a ball mark quickly, by inserting the blade of the tool into the greens turf and with inward leverage relieve the compaction by forcing the turf back into its normal position with the least amount of damage to the grass and its root system.

A fourth object is to provide an impact relief tool that promotes the proper method of repairing a ball mark caused by a golf ball striking the surface of a green.

A fifth object is to provide an impact relief tool that is simple and easy to use, which requires the least amount of physical exertion.

A sixth object is to provide an impact relief tool that is economical in cost to manufacture.

A seventh object is to provide an impact relief tool which is conveniently attached to a belt, pants or shirt pocket.

An eighth object is to provide an impact relief tool that is an attractively displayed tool, which performs an extremely necessary function in the overall care and maintenance of a golf course green, as well as promotes good golf etiquette.

A ninth object is to provide an impact relief tool that when inserted into the green's turf, exceeds below the impaction area caused by a golf ball striking a green to properly relieve this impaction and provided relief from future settling, dimpling, discoloration and death of the grass in the immediate ball mark area.

A tenth object is to provide an impact relief tool with twenty different types of blades, that offer the same function for various types of conditions that exist on various golf courses throughout the world, or twenty optional styles for choice based on personal preference.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and description within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a diagrammatic and schematic view of a portion of a golf course green, showing a golf ball making a ball mark on the golf course green, the golf ball's penetration into the green's turf and the underlying compaction (trauma to the root system not visible to the eye).

FIG. 2 is a cross sectional view through the turf of the golf green, showing a blade of the present invention inserted into the impact area of the ball mark, and the direction of leverage to force the turf back into its normal level position.

FIG. 3 is a perspective view of a first embodiment of the present invention having a fixed blade.

FIG. 4 is a front view taken in the direction of arrow 4 in FIG. 3.

FIG. 5 is a perspective view of a second embodiment of the present invention having a foldable blade, partly unfolded.

FIG. 6 is a perspective view taken in the direction of arrow 6 in FIG. 5, showing the foldable blade completely folded into the handle having a belt clip.

FIG. 9A is a perspective view showing the second embodiment in a protective sheath worn on the belt of the green's keeper.

FIG. 14 is a perspective view of the first embodiment with the handle broken away, in which the blade is a flat type.

FIG. 15 is a perspective view similar to FIG. 14, in which the blade is a curved type.

FIG. 16 is a perspective view similar to FIG. 14, in which the flat blade type has a central longitudinal slot extending from the forward end.

FIG. 17 is a perspective view similar to FIG. 15, in which the curved blade type has a central longitudinal slot extending from the forward end.

FIG. 18 is a perspective view of a seventh embodiment of the present invention having a foldable flat blade type and a foldable slotted blade type being a combination of two blades.

Similar reference characters denote corresponding features consistently throughout the attached drawings.

DESCRIPTION OF THE PREFERRED EMBODIMENTS

Figure 7:
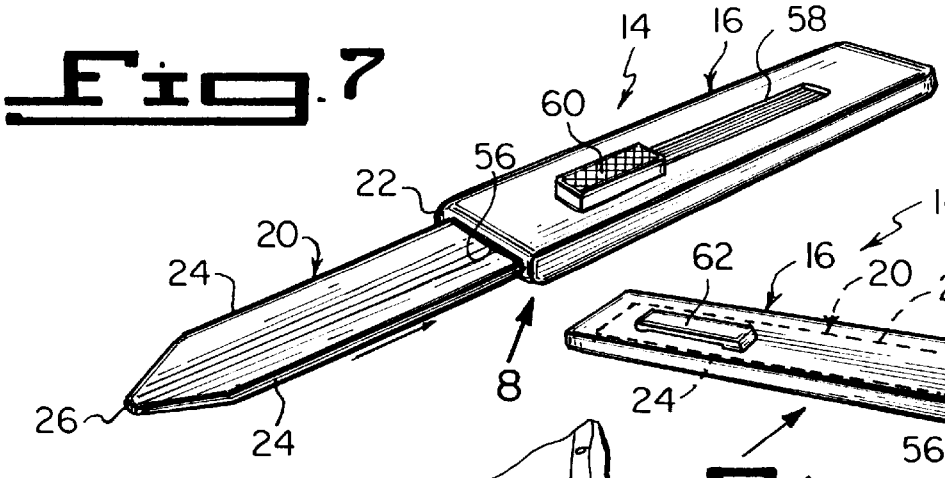
FIG. 7 is a perspective view of a third embodiment of the present invention having a retractable blade.

Turning now descriptively to the drawings, in which similar reference characters denote similar elements throughout the several views, FIGS. 1 through 31 illustrate the present invention being an impact relief tool 14. With regard to the reference numerals used, the following numbering is used throughout the various drawing figures.

14 impact relief tool
16 handle of 14
18 person
20 blade of 14
22 front end of 16
24 dull edge of 20
26 blunt point of 20
28 concave ball mark in 32
29 compacted area in 32
30 golf ball
32 golf green turf
34 knurled surface on 16
36 identification area on 16
38 longitudinal slot in 40
40 long edge of 16
42 recessed thumb rest in 16
44 shank of 20
46 pivot pin in 16
48 leaf or coil spring in 38
50 push lever or button release mechanism in 42
52 clip on 16
53 protective sheath for 14
54 belt of 18
55 identification area on 53
56 first longitudinal slot in 16
58 second longitudinal slot in 16
60 slide button in 58 on 20
62 clip on 16
64 pocket on 66
66 shirt of 18
68 guard on 22 of 16
70 finger grip on 16
72 finger grip on 40
74 flat type for 20
76 curved type for 20
78 central longitudinal slot in 74
80 central longitudinal slot in 76

The impact relief tool 14 comprises a handle 16 to be grasped by a hand of a person 18. A blade 20 extends from a front end 22 of the handle 16. The blade 20 has dull edges 24 formed thereon and a blunt point 26 on a forward end, so that it can be easily inserted by the person 18 below a concave ball mark 28 and compacted area 29 made by a golf ball 30 striking a golf green turf 32, to leverage the golf green turf 32 inwardly relieving the compacted area 29 and for repair and leveling thereof.

The handle 16 may include a knurled surface 34 thereon to be better grasped by the hand of the person 18. The handle 16, as shown in FIG. 3, could also include an identification area 36 on at least one side, so that a logo, insignia, trade name or trademark can be embossed, inlaid, screened, molded, imprinted, raised, engraved or etched upon the identification area 36 for identification purposes. The blade in FIGS. 3 and 4 are fixed to the handle 16. The handle 16 may also be of a smooth surface, as which to inscribe a logo, shield, trade name, trademark or insignia, by the use of etching, engraving, inking, scrimshaw, embossing, inlaying or screening.

The impact relief tool 14, as best seen in FIGS. 5 and 6, can further consist of the handle 16 having a longitudinal slot 38 extending inwardly from the front end 22 on a long edge 40 and may have a recessed thumb rest 42 on one side adjacent the front end 22. The blade 20 has a shank 44 on a rearward end opposite from the blunt point 26 on the forward end. The shank 44 of the blade 20 fits into the longitudinal slot 38 at the front end 22 of the handle 16 and locks into a working position by the use of four optional locking designs (see FIG. 31). A pivot pin 46 extends transversely through the handle 16 at the front end 22 and the shank 44 of the blade 20, to allow the blade 20 to pivot from the working locked extended position, to a stored foldable position within the longitudinal slot 38 in the handle 16. A leaf or coil spring 48 is mounted in bottom of the longitudinal slot 38 of the handle 16 to bias the blade 20 in the working locked extended position.

A push lever or button release mechanism 50 is on one side of the handle. When the push lever or button release mechanism 50 is manually depressed, it will release the blade 20 that was placed in the stored foldable position, so that the blade 20 can go into the working locked extended position by operation of the leaf or coil spring 48. The pivot pin 46 can be removable from the handle 16, so that the blade 20 can be easily removed and changed. FIG. 6 shows a clip 52 affixed onto one side of the handle 16, so that the impact relief tool 14 can be worn on a belt 54 or a pants pocket of the person 18 when not in use (see FIG. 9). The belt clip 52 may be either formed molded to the handle 16 or mechanically fastened to the handle 16. The clip 52 can be mechanically fastened by the use of a threaded fastener, so that the clip 52 can be easily removed.

In FIG. 9A, a protective sheath 53 is worn on the belt 54 of the person 18, so that the impact relief tool 14 can be stored into the protective sheath 53 when not in use. The protective sheath 53 includes an identification area 55, so that a logo, insignia, trade name or trademark can be imprinted upon the identification area 55 or stitched into the protective sheath 53 for identification purposes.

Figure 8:
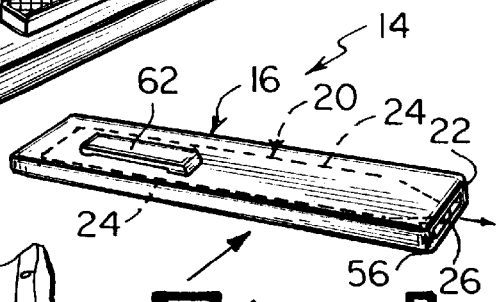
FIG. 8 is a perspective view taken in the direction of arrow 8 in FIG. 7, showing the retractable blade retracted into the handle having a pocket clip.
Figure 9:
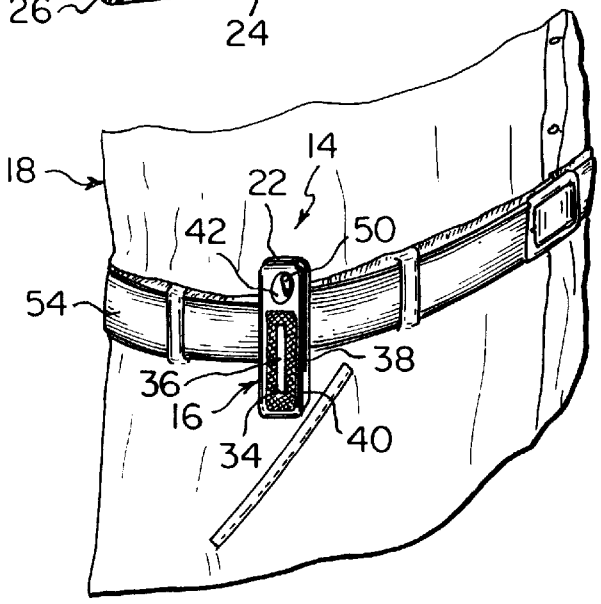
FIG. 9 is a perspective view showing the second embodiment clipped onto a belt of the greens keeper.
Figure 10:
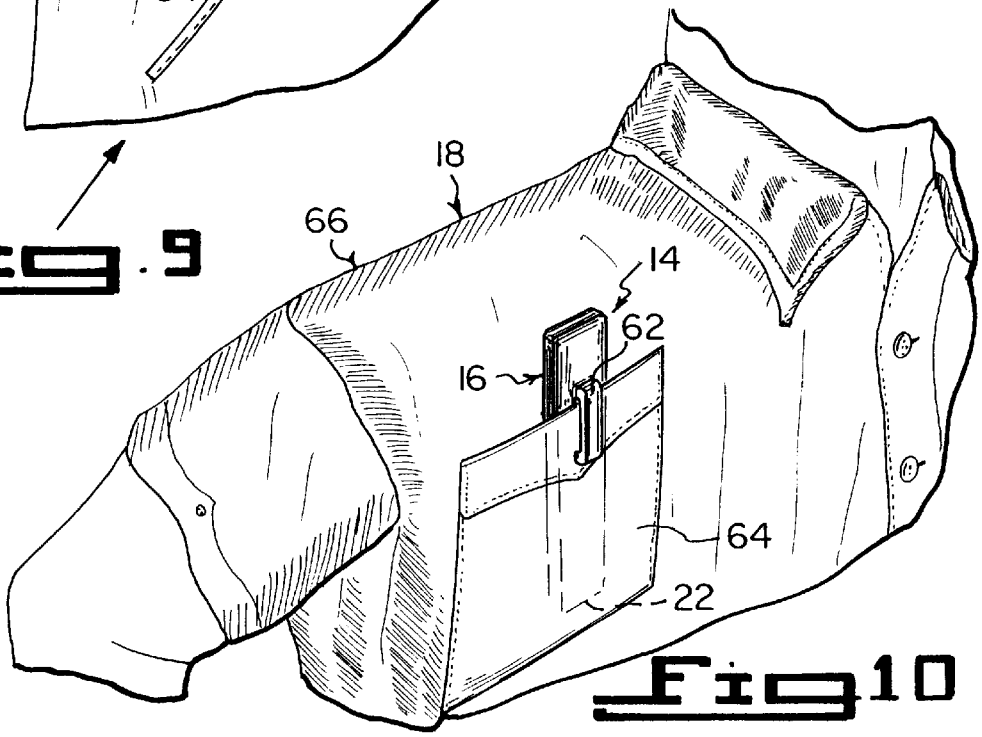
FIG. 10 is a perspective view showing the third embodiment clipped into a shirt pocket of the greens keeper.

The impact relief tool 14, shown in FIGS. 7 and 8, consists of the handle 16 having a first longitudinal slot 56 extending inwardly from the front end 22 and a second longitudinal slot 58 in one side communicating with the first longitudinal slot 56. A rearward end of the blade 20 can be inserted within the first longitudinal slot 56 at the front end 22 of the handle 16 and slide therein. A slide button 60 extends through the second longitudinal slot 58 in the handle 16 and is connected to the rearward end of the blade 20. When the slide button 60 is manually moved by a thumb of the person 18 to a forward end of the second longitudinal slot 58, the blade 20 will slide outwardly to a working locked extended position, as in FIG. 7. When the slide button 58 is manually moved to a rearward end of the second longitudinal slot 58, the blade 20 will slide inwardly to a stored retracted position within the handle 16, as in FIG. 8. A clip 62 is affixed onto one side of the handle 16, so that it can be worn in a pocket 64 on a shirt 66 or pants of the person 18 when not in use (see FIG. 10).

Figure 11:
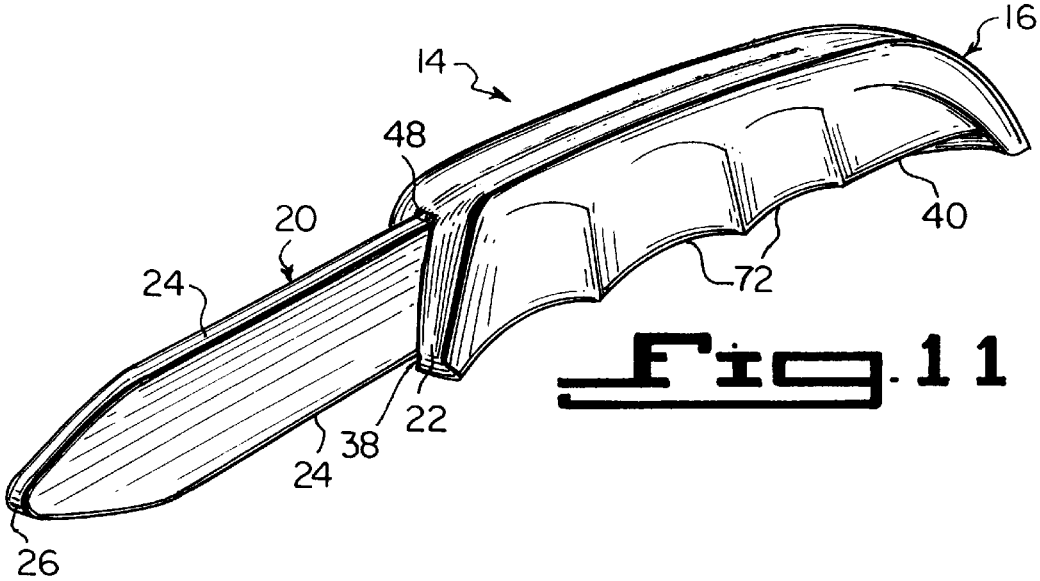
FIG. 11 is a perspective view of a fourth embodiment of the present invention having a foldable blade completely unfolded from a handle with finger grips.
Figure 12:
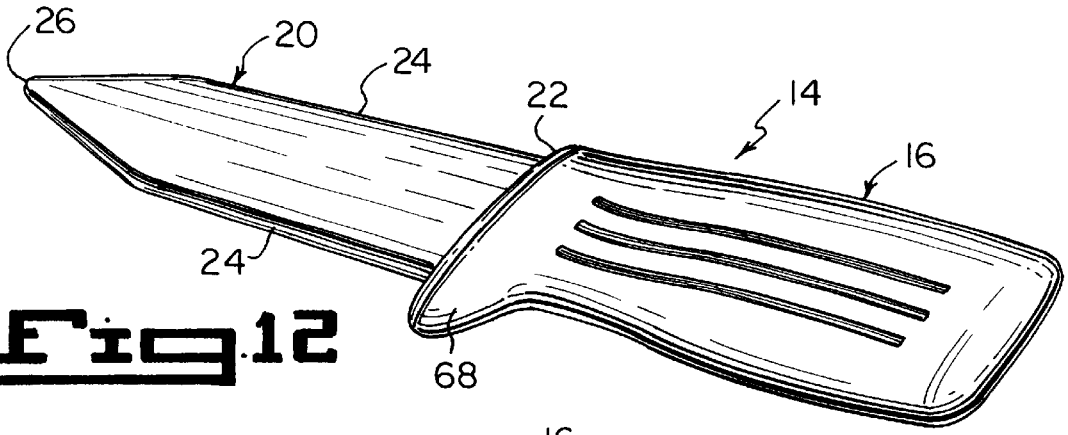
FIG. 12 is a perspective view of a fifth embodiment of the present invention having a fixed blade in a handle with a guard.
Figure 13:
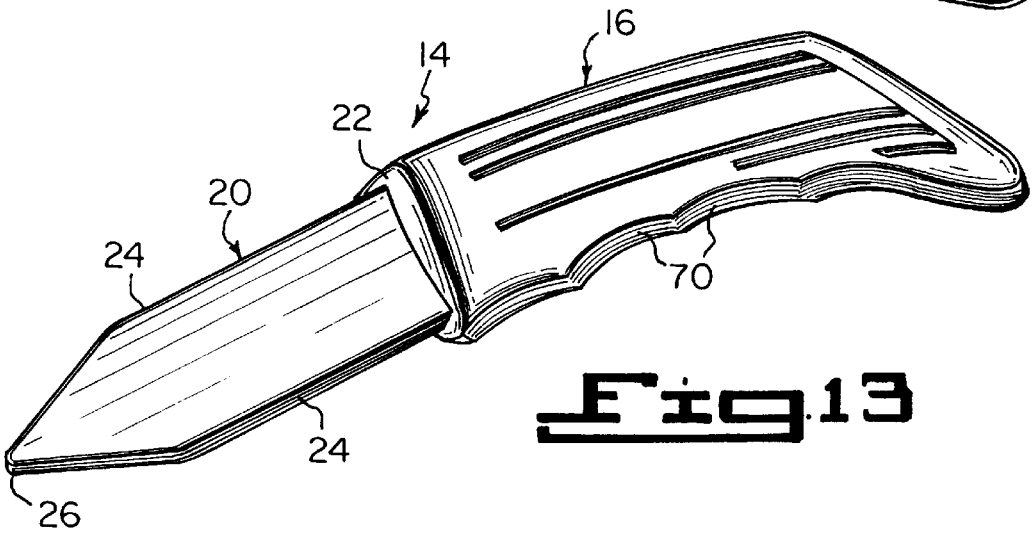
FIG. 13 is a perspective view of a sixth embodiment of the present invention having a fixed blade in a handle with finger grips.
Figure 19:
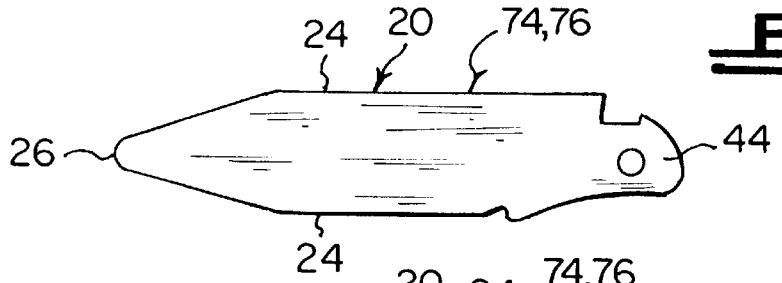
FIG. 19 is a diagrammatic plan view of the blade being either the flat type or curved type.
Figure 20:
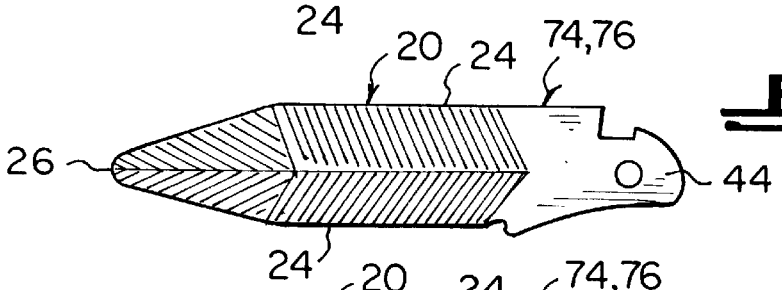
FIG. 20 is a diagrammatic plan view of the blade being either the flat type or curved type, beveled from the center to the dull edges.
Figure 21:
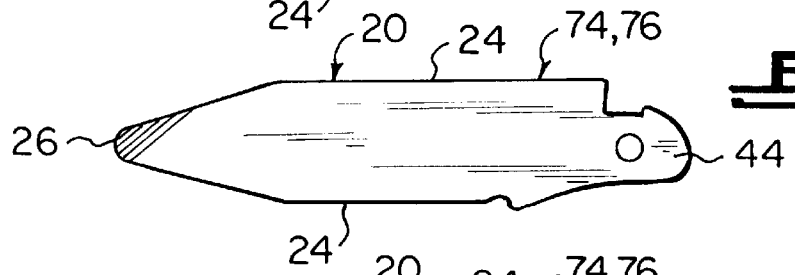
FIG. 21 is a diagrammatic plan view of the blade being either the flat type of curved type, chiseled at the blunt point on the forward end.
Figure 22:
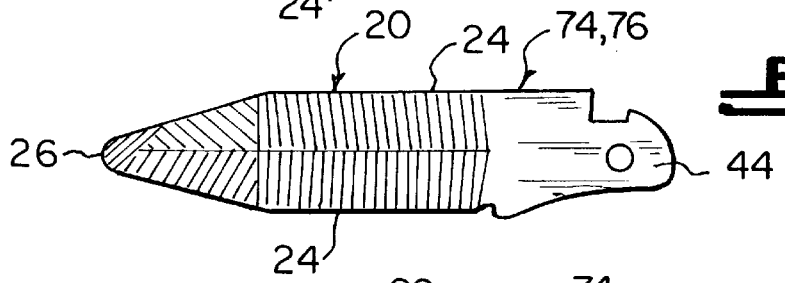
FIG. 22 is a diagrammatic plan view of the blade being either the flat type of curved type, beveled from the center to the dull edges and chiseled at the blunt point on the forward end.
Figure 23:
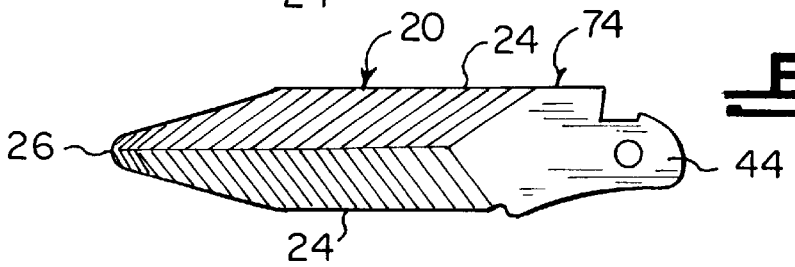
FIG. 23 is a diagrammatic plan view of the blade being the flat type and beveled from the dull edges to the center.
Figure 24:
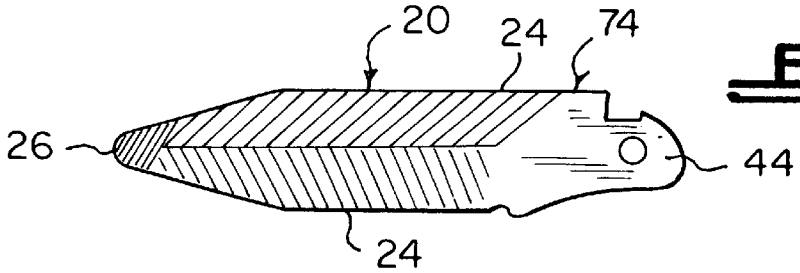
FIG. 24 is a diagrammatic plan view of the blade being the flat type beveled from the dull edges to the center and chiseled at the blunt point on the forward end.
Figure 25:
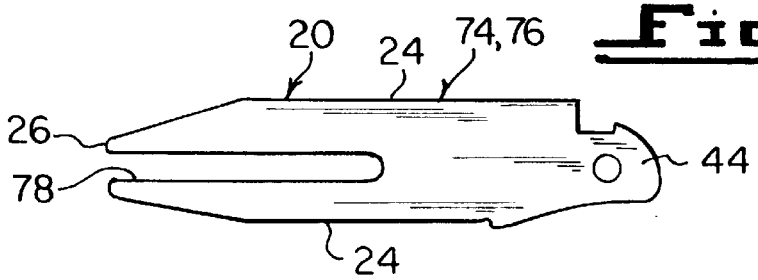
FIG. 25 is a diagrammatic plan view of the blade being either the flat type or curved type, having a central longitudinal slot extending from the blunt point on the forward end.
Figure 26:
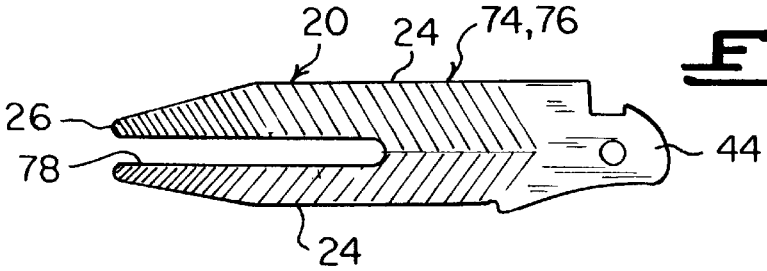
FIG. 26 is a plan view of the blade being either the flat type or curved type, having a central diagrammatic longitudinal slot extending from the blunt point on the forward end and beveled from the center of the blade to the dull edges.
Figure 27:
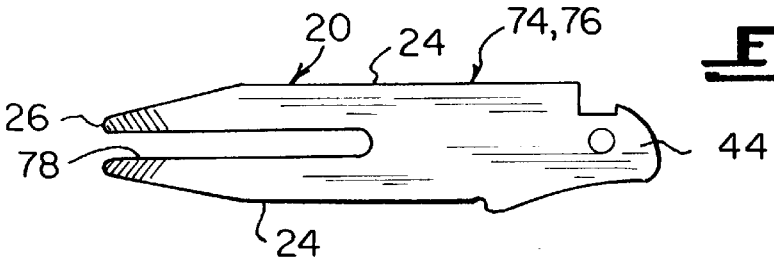
FIG. 27 is a diagrammatic plan view of the blade being either the flat type or curved type, having a central longitudinal slot extending from the blunt point on the forward end and chiseled at the blunt point on the forward end.
Figure 28:
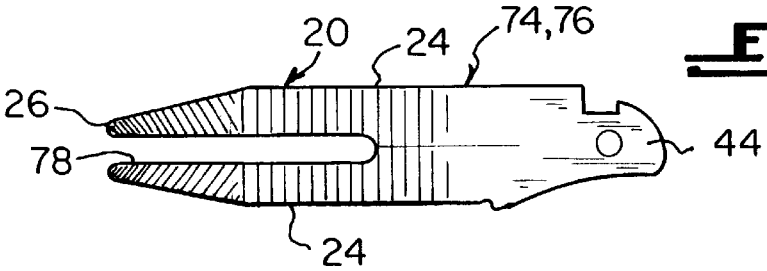
FIG. 28 is a diagrammatic plan view of the blade being either the flat type of curved type, having a central longitudinal slot extending from the blunt point on the forward end, beveled from the center to the dull edges and chiseled at the blunt point on the forward end.
Figure 29:
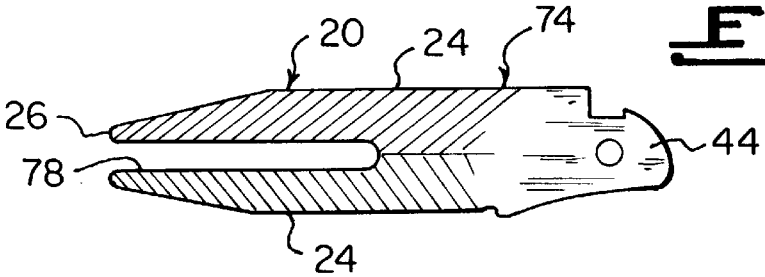
FIG. 29 is a diagrammatic plan view of the blade being the flat type, having a central longitudinal slot extending from the blunt point on the forward end and beveled from the dull edges to the center.
Figure 30:
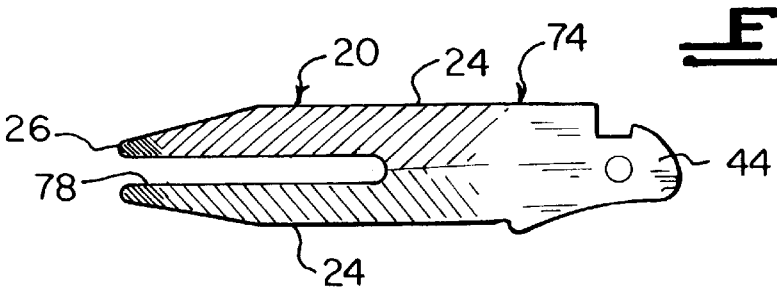
FIG. 30 is a diagrammatic plan view of the blade being the flat type, having a central longitudinal slot extending from the blunt point on the forward end, beveled from the dull edges to the center and chiseled at the blunt point on the forward end.
Figure 31:
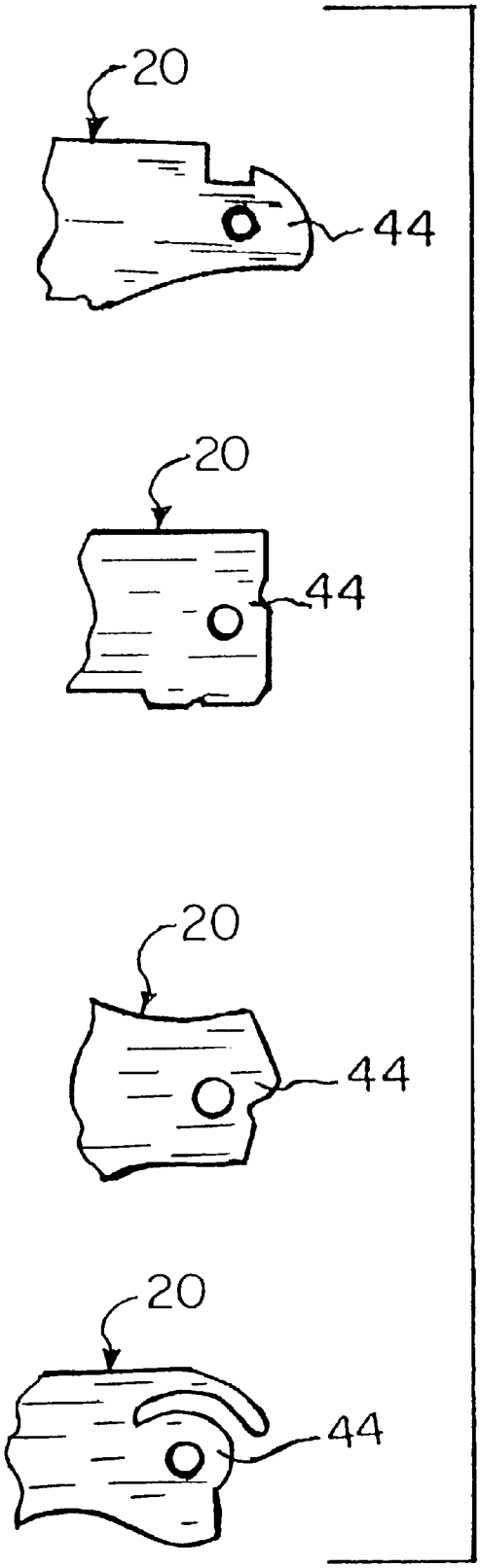
FIG. 31 shows diagrammatic plan views of four optional locking designs for the shanks of the blade.

The impact relief tool 14 in FIG. 12, shows the handle 16 with a guard 68 formed on the front end 22, so as to protect the hand of the person 18 grasping the handle 16. The impact relief tool 14 in FIG. 13, shows the handle 16 having finger grips 70 formed on a long edge, so that the handle 16 will be better grasped by the hand of the person 18. The blades 20 in FIGS. 12 and 13 are also fixed to the handle 16. The impact relief tool 14 in FIG. 11, shows the handle 16 also having finger grips 72 formed on the long edge 40 having the longitudinal slot 38, so the handle 16 will be better grasped by the hand of the person 18. The blade 20 in FIG. 11 is foldable with respect to the handle 16.

In FIG. 14 the blade 20 is a flat type 74 between the dull edges 24, while the blade 20 in FIG. 15 is a curved type 76 between the dull edges 24. FIG. 16 shows the flat type 74 of the blade 20 having a central longitudinal slot 78 extending from the blunt point 26 on the forward end, while in FIG. 17 the curved type 76 of the blade 20 has a central longitudinal slot 80 extending from the blunt point 26 on the forward end.

The impact relief tool 14 in FIG. 18 further includes a first blade 20 being the flat type 74 between the dull edges 24. A second blade 20 is also provided, being the flat type 74 between the dull edges 24 and having the central longitudinal slot 78 extending from the blunt point 26 on the forward end. The shank 44 is on a rearward end opposite from the blunt point 26 on the forward end. The shank 44 fits into the longitudinal slot 38 at the front end 22 of the handle 16 to pivot on the pivot pin 46, to allow either of the blades 20 to pivot from a working locked extended position, to a stored foldable position within the longitudinal slot 38 in the handle 16.

There are twenty different kinds of blades 20 used in the present invention.

1. Flat type 74 shown in FIG. 19.
2. Flat type 74 that is beveled from the center to the dull edges 24, shown in FIG. 20.
3. Flat type 74 that is chiseled at the blunt point 26, shown in FIG. 21.
4. Flat type 74 that is beveled from the center to the dull edges 24 and is chiseled at the blunt point 26, shown in FIG. 22.
5. Flat type 74 that is beveled from the dull edges 24 to the center, shown in FIG. 23.
6. Flat type 74 that is beveled from the dull edges 24 to the center and chiseled at the blunt point 26, shown in FIG. 24.
7. Flat type 74 with the central longitudinal slot 78, shown in FIG. 25.
8. Flat type 74 with the central longitudinal slot 78, that is beveled from the center to the dull edges 24, shown in FIG. 26.
9. Flat type 74 with the central longitudinal slot 78, that is chiseled at the blunt point 26, shown in FIG. 27.
10. Flat type 74 with the central longitudinal slot 78, that is beveled from the center to the dull edges 24, and chiseled at the blunt point 26, shown in FIG. 28.
11. Flat type 74 with the central longitudinal slot 78 that is beveled from the dull edges 24 to the center, shown in FIG. 29.
12. Flat type 74 with the central longitudinal slot 78, that is beveled from the dull edges 24 to the center and chiseled at the blunt point 26, shown in FIG. 30.
13. Curved type 76, shown in FIG. 19. 14. Curved type 76 that is beveled from the center to the dull edges 24, shown in FIG. 20.
15. Curved type 76 that is chiseled at the blunt point 26, shown in FIG. 21.
16. Curved type 76 that is beveled from the center to the dull edges 24 and is chiseled at the blunt point 26, shown in FIG. 22.
17. Curved type 76 with the central longitudinal slot 78, shown in FIG. 25.
18. Curved type 76 with the central longitudinal slot 78 that is beveled from the center to the dull edges 24, shown in FIG. 26.
19. Curved type 76 with the central longitudinal slot 78 that is chiseled at the blunt point 26, shown in FIG. 27.
20. Curved type 76 with the central longitudinal slot 78 that is beveled from the center to the dull edges 24 and is chiseled at the blunt point 26, shown in FIG. 28.

All or any combination of these blades 20 will work in the combination tool, shown in FIG. 18.

Operation of the Invention

The tool 14 is designed to perform the proper repair of unsightly ball marks 28, or those of which have been wrongly repaired or have been totally neglected to be repaired, by utilizing a similar or as near application as the aforementioned deep thinning process, to relieve "trauma and compaction", and cause the least amount of grass plant damage, while performing repair to the putting surface, to a condition of nearly no imperfections, including repair to the underlying damage, "trauma and compaction" caused by a golf ball 30 striking the surface of a green 32; damage that exists beneath the indentation of the ball mark area 29.

Fixed improperly, the invisible bruise to the grass plants and it's root system "trauma and compaction" caused by a golf ball 30 striking the surface of the green 32, which exist beneath the indentation of the ball mark 28, will surface days later as unsightly blemishes, dimples, discoloration and death of the grass plants in the immediate ball mark area.

Fixed properly, most grass plants used on golf course greens 32 will rejuvenate in extremely short periods of time, depending on the total health of the grass plants, the make-up of the green 32, the depth of the ball mark 28, and the amount of "trauma and compaction" caused to the grass plants and their underlying root systems. All factors, being cooperative, weather, sun, moisture, time of year, healthy conditions, etc., rejuvenation can be accomplished within twenty four hours. Of course, under adverse, or extreme conditions, or when a ball mark 28 is deeply embedded, rejuvenation of the grass plants takes longer.

Remember the user of the tool 14 is to perform the same near function as the aforementioned deep thine method, but in a more restricted application. If the golf ball 30 is embedded into the surface of the green 32, remove, if not, continue as follows. First remove any dislodged, torn, or ripped thatch (turf that has been separated). Do not place it back in the indentation, for it will not grow. Save it to discard later when you leave the green area. Do replace the sand, soil or greens mixed back into the indentation. Lightly pat down with the ball of your foot the ridge (undulation around impacted indented area).

Insert the blade 20 of the impact relief tool 14 into the turf 32 at a near vertical angle at the rear of the ball mark 28 (point opposite from the entry and flight of the golf ball 30), and leverage inwardly towards the center of the ball mark indentation. Continue in a clockwise or counterclockwise motion around the entire ball mark 28 (all four sides). The turf 32 will rise to the center, forcing the grasses and root system to their near original healthy state. Proceed by again patting the now raised and impact relieved ball mark area lightly with the ball of your foot. The repair is now complete. Take the time to fix someone else's ill repaired, or unrepaired ball mark 28. Cleaning of the impact repair tool 14 is easily accomplished by swiping the blade 20, flat or curved sides down, through the grass in the rough area off the surface of the green, if needed.

Insertion of the blade 20 should be at a depth of at least one and one half times the depth of the ball mark 28. Personal judgement and common sense and the overall condition of the green (dry-wet and etc.) will regulate the depth of insertion. In worst case applications (usually on extremely compacted greens or heavily shaded or diseased greens, or when a golf ball 30 is deeply embedded), it may be necessary to first pierce the center of the ball mark 28 with the blade 20 of the tool 14, prior to proceeding with the aforementioned instructions. In doing so, the user should insert the blade 20 in the center and parallel same directions as the ball mark 28, then with a slight side to side movement create a small void in the turf past the depth of impact and trauma beneath the ball mark 28. By doing this, the user will easily relieve the most difficult areas of "trauma and compaction", and performance of the proper repair may be completed with ease.

The user should not utilize the tool 14 by prying up on the ball mark "indentation", this is not a prying tool, and prying is not the proper method of fixing a ball mark 28. Prying up only causes more damage to the grass plant by ripping the root system and is very seldom effective in reaching the bottom of the impact area underneath the surface of the ball mark 28. Common sense and the mere difficulty of trying to pry up on a tool 14 that is deeply embedded into the body of the green should help prevent the user from preforming improper repair. By inserting the blade 20 of the impact relief tool 14 at a near vertical angle, the user is capable of performing the repair to nearly zero imperfections with the least amount of damage and trauma to the grass plant, including its delicate root system, allowing and promoting the most expedient recovery of the plant to its healthy state. All defects mentioned before should be repaired in this manner. Bird droppings, grease and oil droppings should be scalped off, utilizing the blade 20, to a point below the damaged area then proceed as above. If caught in time, and (repaired as soon as possible) the grass will rejuvenate.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. The method of relieving an impact caused by a golf ball striking and indenting the turf of a golf green comprising the steps of:

a) piercing the center of an indentation with a blade of an impact relief tool and sliding said blade side to side to create a small void in the turf past the sides of the indentation, said impact relief tool comprising:

1. a handle to be grasped by a hand of a person;
2. a substantially flat and solid blade extending from a front end of said handle, said blade having a pair of coextensive dull edges along opposite sides thereof formed thereon and said sides coming together to form a single blunt point on a forward end, so that said blade can be easily inserted by the person below a concave ball mark and compacted area made by a golf ball striking a golf green turf, to leverage the golf green turf inwardly relieving the compacted area for repair and leveling thereof;
3. said handle having a knurled surface for grasping and a longitudinal slot extending inwardly from said front end on a long edge;
4. said blade having a shank on a rearward end opposite from said blunt point on said forward end, whereby said shank of said blade fits into said longitudinal slot at said front end of said handle, and means for locking said blade into an extended working position;
5. a removable pivot pin extending transversely through said handle at said front end and said shank of said blade, to allow replacement of said blade and to pivot from the working locked extended position to a stored folded position within said longitudinal slot in said handle, said pin being removable to permit replacement of said blade;
6. a push release mechanism on one side of said handle, which when manually depressed, will release said blade that was placed in the stored, folded position, so that said blade can go into the working locked extended position; and
7. a clip affixed onto one side of said handle, so that said tool can be worn on a belt when not in use, said clip mechanically fastened in such a manner that said clip can be easily removed;

b) remove from said indentation any dislodged, torn or ripped thatch;

c) replace any sand, soil or greens mixed back into the indentation;

d) lightly pat down any ridge surrounding the indentation;

e) insert said blade of said impact relief tool into the turf at a near vertical angle at a point on an edge of the indentation opposite from the entry of the golf ball to a depth of at least one and one half times the depth of the indentation;

f) leverage said blade inwardly towards the center of said indentation;

g) repeat the preceding step at all of the other sides of said indentation, causing the turf within said indentation to rise to the center, forcing grasses and root system to their near original healthy state; and h) patting the now raised and impact relieved ball mark area lightly.

* * * * *